US008389465B2

(12) United States Patent
Breffa et al.

(10) Patent No.: US 8,389,465 B2
(45) Date of Patent: Mar. 5, 2013

(54) ISOSORBIDE MONOESTERS AND THEIR USE IN HOUSEHOLD APPLICATIONS

(75) Inventors: Catherine Breffa, Düsseldorf (DE); Burkhard Beckedahl, Düsseldorf (DE); Markus Dierker, Düsseldorf (DE); Ansgar Behler, Bottrop (DE); Teresa Alexandre, Düsseldorf (DE); Thorsten Löhl, Schmallenberg (DE); Claus Nieendick, Krefeld (DE); Sabine Both, Neuss (DE); Manfred Weuthen, Langenfeld (DE)

(73) Assignee: Cognis IP Management GmbH, Duesseldorf (DE)

( * ) Notice: Subject to any disclaimer, the term of this patent is extended or adjusted under 35 U.S.C. 154(b) by 0 days.

(21) Appl. No.: 13/263,421

(22) PCT Filed: Mar. 31, 2010

(86) PCT No.: PCT/EP2010/002045

§ 371 (c)(1), (2), (4) Date: Oct. 7, 2011

(87) PCT Pub. No.: WO2010/115565

PCT Pub. Date: Oct. 14, 2010

(65) Prior Publication Data

US 2012/0035090 A1 Feb. 9, 2012

(30) Foreign Application Priority Data

Apr. 9, 2009 (EP) ..... 09005187

(51) Int. Cl.

| | |
|---|---|
| ***C11D 3/20*** | (2006.01) |
| ***C11D 3/22*** | (2006.01) |
| ***C11D 7/26*** | (2006.01) |
| ***C11D 13/10*** | (2006.01) |

(52) U.S. Cl. ..... 510/505; 510/474; 549/464

(58) Field of Classification Search ..... 510/474, 510/505; 549/464

See application file for complete search history.

(56) References Cited

U.S. PATENT DOCUMENTS

| | | | | |
|---|---|---|---|---|
| 3,988,255 | A * | 10/1976 | Seiden | 510/151 |
| 8,008,246 | B2 * | 8/2011 | Breffa et al. | 510/505 |
| 2002/0174596 | A1 | 11/2002 | Deflort et al. | |

FOREIGN PATENT DOCUMENTS

| | | |
|---|---|---|
| CN | 1880423 | 12/2006 |
| EP | 0693049 | 9/1998 |

(Continued)

OTHER PUBLICATIONS

Sahasrabudhe, Madhu R. et al., "Chromatographic Analysis of Sorbitan Fatty Acid Esters", *The Journal of the American Oil Chemists Society*, vol. 46, No. 1 1969 , 8-12.

(Continued)

*Primary Examiner* — Brian P Mruk

(74) *Attorney, Agent, or Firm* — Servilla Whitney LLC

(57) ABSTRACT

Isosorbide monoesters according to the general formula (I) wherein R' or R" represent a hydrogen atom, or an group CO—R'", with the proviso that one group R' or R" is a hydrogen atom, and R'" represents linear or branched, saturated or unsaturated alkyl- or alkenyl groups with 6 to 22 C-atoms are useful compounds in the preparation of all kind of detergents, in particular dish washing detergents or of cosmetic preparations.

(I)

13 Claims, 1 Drawing Sheet

FOREIGN PATENT DOCUMENTS

| | | |
|---|---|---|
| JP | 59-175408 | 10/1984 |
| WO | WO-94/22800 | 10/1994 |
| WO | WO-01/83488 | 11/2001 |
| WO | WO-2005/049775 | 6/2005 |
| WO | WO-2005/102265 | 11/2005 |

OTHER PUBLICATIONS

PCT International Search Report for PCT/EP2010/002045, Jun. 18, 2010, 6 pages.

* cited by examiner

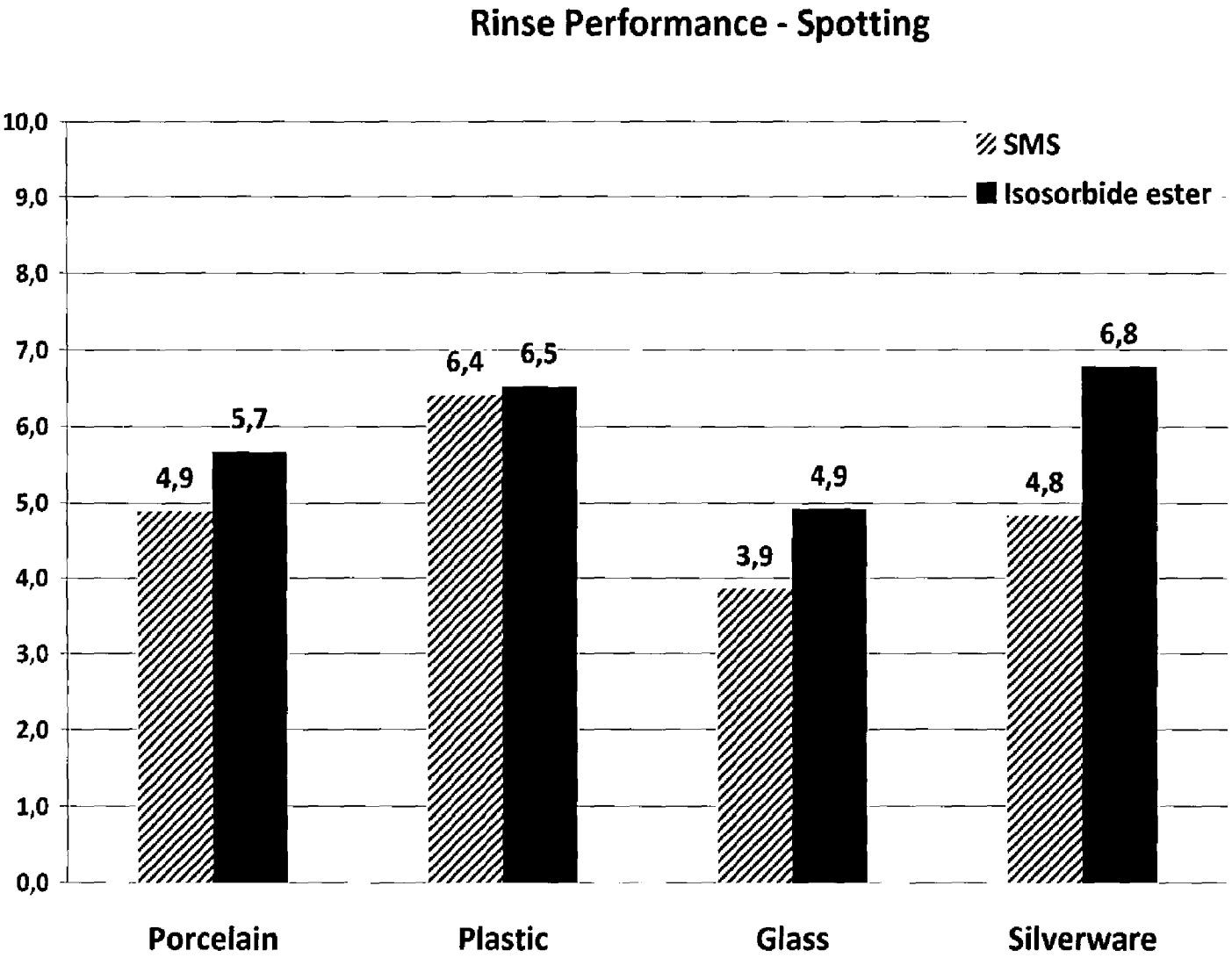
Rinse Performance - Spotting
SMS
Isosorbide ester
10,0
9,0
8,0
7,0
6,0
5,0
4,0
3,0
2,0
1,0
0,0
4,9
5,7
6,4
6,5
3,9
4,9
4,8
6,8
Porcelain
Plastic
Glass
Silverware

ISOSORBIDE MONOESTERS AND THEIR USE IN HOUSEHOLD APPLICATIONS

CROSS-REFERENCE TO RELATED APPLICATIONS

This application is the national stage entry of PCT/EP2010/002045, filed on Mar. 31, 2010, which claims priority to European Patent application number 09005187.1, filed on Apr. 9, 2009, both of which are incorporated herein by reference in their entireties.

FIELD

The present application pertains to the use of isosorbide monoesters in household products, like detergents and cleansers, and in particular automatic dish detergents, but also in cosmetic preparations.

BACKGROUND

Isosorbide (or 1,4:3,6-dianhydrosorbitol, see formula below) is the anhydride of sorbitol:

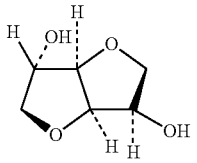

SUMMARY

One aspect of the invention relates to a method of preparing a household cleanser or detergent. The method comprises using an isosorbide monoester, according to general formula (I):

(I)

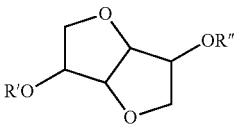

in a household cleanser or detergent. R' or R" represent a hydrogen atom, or a group CO-R'", with the proviso that one group R' or R" is a hydrogen atom, and R'" represents a linear or branched, saturated or unsaturated alkyl- or alkenyl group with 6 to 22 C-atoms.

DETAILED DESCRIPTION

Upon heating sorbitol for example with concentrated sulfuric or hydrochloric acid, two molecules of water are eliminated with the formation of isosorbide. So far, these compounds are also known generally as dianhydrohexitols (including besides isosorbide also the isomers isomannide and isoidide). Besides isosorbide per se, certain derivatives of isosorbide are well known, inter alia mono- and diesters thereof. JP 59-175408 discloses the use of di-fatty acid esters of isosorbide in cosmetic applications. From WO 01/83488 a method to prepare di-fatty acid esters of isosorbide is known.

The documents discloses the use of such diesters as dispersing agents for pigments, preservatives, polymer stabilizers, emulsifiers for cosmetics or as plasticizers for vinyl resins.

The present application pertains in a first embodiment to an isosorbide monoester derivative, according to the general formula (I)

(I)

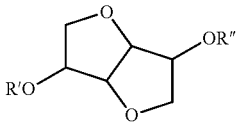

wherein R' or R" represent a hydrogen atom, or a group CO—R'", with the proviso that one group R' or R" is a hydrogen atom, and R'" represents linear or branched, saturated or unsaturated alkyl- or alkenyl groups with 6 to 22 C-atoms. Preferred compounds are the monoesters (either R' or R" is hydrogen) based on groups R' or R" representing linear saturated alkyl moieties with 12 to 18 C-atoms, whereby compounds having 12, 14, 16 and/or 18 C-atoms are of specific advantage.

According to the process of preparation the compounds subject to the teaching of this application contain not only one compound, but a blend of various esters. In particular the mixtures contain 45 to 85 wt % of a monoester, and 40 to 15 wt % of diesters, and the rest up to 100 wt % are non-reacted matter. Preferred are mixtures containing 50 to 90 wt % of monoester plus 10 to 50 wt % of diesters, and optionally non-reacted matter. Preferred are those blends containing more than 50 wt %, and particularly more than 70 wt % of the isosorbide monoester, according to formula (I). Thus, if in the following an "isosorbide mono ester" is mentioned this includes the pure compound, as well as blends of mono- and diesters according to the above description.

According to the kind of preparation the isosorbide esters of the present invention may also contain small amounts of sorbitan esters (mono-, di, tri or mixtures) too, and at maximum up to 3 wt-%, based on the weight of the whole mixture. Nevertheless, compositions free of sorbitan or sorbitan esters could be of advantage and represent an preffered embodiment of the invention.

The preparation of the compounds according to formula (I) can be carried out by known esterification processes. Thus, to obtain the isosorbide monoesters known methods are applicable. For example, an isosorbide may be reacted with a carboxylic acid in the presence of basic or acidic catalysts under elevated pressure (100-500 kPa) and preferably elevated temperatures, for example of 120 to 220° C.

A further embodiment of the invention pertains to the use of compounds according to formula (I) for the preparation of detergents, cleansers and the like (solid, liquid or gel-like ones). The isosorbide ester then may be present preferably in amounts from 0.1 up to 25% by weight, dependent on the particular formulation. Preferably those detergents or cleanser will contain the monoesters in amounts of 1 to 15 wt %, and most preferred from 2 to 10 wt %, and most preferred from 4 to 6 wt %, based on the total weight of the cleanser or detergent.

Isosorbide ethers are known as additive in fuel compositions from US 2002/0174596 A1. From WO 05/102265 A1 blends of sorbitol, sorbitol esters and isosorbide esters as surfactants are known.

It was now found that the isosorbide monoester according to the teaching of this application is particularly useful in a broad spectrum of home care applications, like detergents, and all kind of cleaners (kitchen, bathroom, hard surface, automotive or car cleansers, and multipurpose cleansers), as well as in dishwashing compositions (hand and automatic dish washing), but they can also be used in cosmetic preparations as additive. Detergents according to the invention may contain in general, besides the monoesters of isosorbide, surfactants, builders, salts, bleaching agents, bleach activators, optical brighteners, redeposition inhibitors, soil repellants, solubilizers, foam inhibitors and enzymes as auxiliaries and additives. The detergents could be solid, liquid or gel-like. They could contain water, or could be incorporated into water-free compositions.

A certain and preferred field of application pertains to dishwashing agents, and in particular to automatic dish washing compositions, whereby the inventive isosorbide mono esters could be used with advantage as ingredient.

The cleaners according to the invention may contain, for example, solubilizers, such as ethanol, isopropyl alcohol, ethylene glycol, diethylene glycol or preferably butyl diglycol, foam regulators, for example soap, soluble builders, for example citric acid or sodium citrate, EDTA or NTA, and abrasives as auxiliaries. In many cases, an additional bactericidal effect is required so that the multipurpose cleaners may contain cationic surfactants or biocides, for example glucoprotamine. The cleaners according to the invention may be both alkaline (pH>7.5) or acidic (pH<6.5).

The monoesters according to the present application show advantageous properties in dish detergents, and in particular as rinse aid. Thus, this particular use is a further preferred embodiment of the invention.

Rinse aids are used in commercial and institutional machine dishwashers and very often, also in household automatic dishwashers. During the rinse cycle, a final rinse of fresh water serves to displace pre-final rinse water and its attendant detergent and soil residues. Rinse aid formulations are aqueous solutions containing a low foam nonionic surfactant. During the rinse cycle, the rinse aid is injected into the final fresh water rinse at a concentration of about 100 to about 500 ppm. The surfactant in the rinse water lowers the surface tension of the rinse water and improves the wetting action of the rinse water on the somewhat hydrophobic substrate surfaces. Improved wetting reduces the tendency of the rinse water to form drops containing dissolved solids on the substrate surface which give rise to spots upon drying. Accordingly, the functions of the surfactant in the rinse aid are to effectively reduce the surface tension during the draining period and to be low foaming so as to avoid traces of foam on the rinsed substrate which result in a residue upon evaporation. Commercially available rinse agents are mixtures of nonionic surfactants, solubilizers, organic acids and solvents, water and optionally preservative and perfumes. The function of the surfactants in these compositions is to influence the interfacial tension of the water in such a way that it is able to drain from the tableware as a thin, coherent film so that no droplets of water, streaks or films remain behind during the subsequent drying process (so-called wetting effect). Another function of the surfactants is to suppress the foam generated by food residues in the dishwashing machine. Since the rinse agents generally contain acids to improve the clear drying effect, the surfactants used also have to be relatively hydrolysis-resistant towards acids. Rinse agents are used both in the home and in the institutional sector. In domestic dishwashers, the rinse agent is added after the prerinse and wash cycle at 40 to 65° C. Institutional dishwashers use only one wash liquor which is merely replenished by addition of the rinse agent solution from the preceding wash cycle. Accordingly, there is no complete replacement of water in the entire dishwashing program. Because of this, the rinse agent is also expected to have a foam-suppressing effect, to be temperature-stable in the event of a marked drop in temperature from 85 to 35° C. and, in addition, to be satisfactorily resistant to alkali and active chlorine. The rinse agents may be formulated both as aqueous solutions and in solid form, for example encapsulated in wax, or in gel form. In a particularly preferred embodiment, they are aqueous solutions.

The rinse agents according to the invention may contain, for example, besides the monesters of isosorbide, solubilizers, such as cumene sulfonate, ethanol, isopropyl alcohol, ethylene glycol, propylene glycol, butyl glycol, diethylene glycol, propylene glycol monobutyl ether, polyethylene or polypropylene glycol ethers with molecular weights of 600 to 1,500,000, preferably with a molecular weight of 400,000 to 800,000, or more particularly butyl diglycol as auxiliaries and additives. In addition, organic acids, such as mono- and/or polybasic carboxylic acids, preferably citric acid, and preservatives and perfumes may be used. The use of monoesters of isosorbide show at least a similar, often improved performance as rinse aid, compared with standard rinse aids, like hydroxylated fatty alcohol alkoxylates.

The isosorbide mono esters are also suitable as additive in solid or liquid detergents, and particularly for the use in automatic dish detergents (ADDs). Preferred ADD's are those which contain various additives besides the surfactants, to improve the properties of the surfactants, for examples enhanced drying properties, anti-corrosion properties, better luster on metal etc. (so called multi-functional ADDs).

The cleaning of hard surfaces and particularly the washing of dishes impose particular demands on the preparations used. This applies in particular to automatic dishwashing. The three components of the automatic system are detergent, rinse agent and regenerating salt for softening water. The key functions of the principal constituent, the detergent, are soil separation, soil dispersion, the binding of residual water hardness and corrosion inhibition. Following the trend towards simplified use, many manufacturers today offer their customers multifunctional dish detergents, i.e., the detergent additionally contains rinse agents and water softeners or agents for retaining shine on metal surfaces or for protection against silver discoloration after washing, so that the customer does not have to use separate agents to perform these functions, but instead achieves the desired result with only a single supply form. A key parameter in dishwashing is rinse performance. This determines the extent of deposits on the items of tableware after washing. The deposits are essentially mineral compounds, more particularly Ca and/or Mg salts, but also surfactant residues. However, it is principally lime which leads to the deposits so disliked by the consumer. In order to reduce the extent of these deposits, conventional dish detergents, particularly automatic dish detergents, generally contain so-called rinse agents. Branded rinse agents are usually mixtures of low-foaming nonionic surfactants, typically fatty alcohol polyethylene/polypropylene glycol ethers, solubilizers (for example cumene sulfonate), organic acids (for example citric acid) and solvents (for example ethanol). The function of the rinse agents is to influence the interfacial tension of the water in such a way that it is able to drain from the tableware in the form of a very thin, coherent film, so that no droplets of water, streaks or films are left behind after the subsequent drying phase. There are two kinds of deposits, namely: spotting, which is caused by drying water droplets, and filming, i.e., layers formed by the drying of thin films of water. Accordingly, it is understandable why there is a continuing demand for improved rinse agents which are expected not only to provide an improvement in clear rinse performance, but also to avoid the practical problems mentioned above.

The isosorbide monoesters may be formulated together with other surfactants, like anionic, nonionic, amphoteric and/or cationic surfactants.

Anionic surfactants according to the present invention include aliphatic sulfates, such as fatty alcohol sulfates, fatty alcohol ether sulfates, fatty acid polyglycol ester sulfates, dialkyl ether sulfates, monoglyceride sulfates and aliphatic sulfonates, such as alkane sulfonates, olefin sulfonates, ether sulfonates, n-alkyl ether sulfonates, ester sulfonates, and lignin sulfonates. Fatty acid cyanamides, sulfosuccinic acid esters, fatty acid isethionates, acylaminoalkane sulfonates (fatty acid taurides), fatty acid sarcosinates, ether carboxylic acids and alkyl (ether) phosphates may also be used for the purposes of the invention, but are not preferred. Preferred anionic surfactants in the sense of the present invention are selected from the group of fatty alcohol sulfates, fatty alcohol ether sulfates and/or fatty acid polyglycol ester sulfates, and mixtures thereof.

Typical examples of nonionic surfactants are alkoxylates of alkanols, end-capped alkoxylates of alkanols with no free OH groups, alkoxylated fatty acid lower alkyl esters, amine oxides, alkylphenol polyglycol ethers, fatty acid polyglycol esters, fatty acid amide polyglycol ethers, fatty amine polyglycol ethers, alkoxylated triglycerides, mixed ethers and mixed formals, fatty acid-N-alkyl glucamides, protein hydrolyzates (more particularly wheat-based vegetable products), polyol fatty acid esters. However, the co-use of sorbitol, and/or sorbitolesters together with the isosorbide monoesters of the present invention, according to the teaching of WO 05/102265 A1 is excluded.

If the nonionic surfactants contain polyglycol ether chains, they may have a conventional homolog distribution although they preferably have a narrow homolog distribution. The other nonionic surfactants are preferably selected from the group consisting of alkoxylates of alkanols, more particularly fatty alcohol polyethylene glycol/polypropylene glycol ethers or fatty alcohol polypropylene glycol/polyethylene glycol ethers, end-capped alkoxylates of alkanols, more particularly end-capped fatty alcohol polyethylene glycol/polypropylene glycol ethers or end-capped fatty alcohol polypropylene glycol/polyethylene glycol ethers, and fatty acid lower alkyl esters and amine oxides.

Preferred nonionic surfactants have a structure according to the following formula $RO[CH_2CHR'O]_x[CH_2CH2O]_y[CH_2CHR'O]_zCH_2CHOH—R''$, whereby R and R'' represent independently from each other a saturated or unsaturated, branched or linear alkyl or alkenyl moiety with 6 to 22 C-atoms, and R' stands for $CH_3$ or $CH_2CH_3$-groups, and x and z might be independently zero, or 1 to 40, and z is at least 1 and at maximum 50. The distribution of the different alkoxide groups within this molecule might be randomized or block wise. Corresponding products and their use in the cleaning of hard surfaces are the subject of, for example, European patent EP 0 693 049 B1 and International patent application WO 94/22800 and the documents cited therein. These nonionic surfactants are preferred nonionic surfactants within the present invention.

Alkyl and alkenyl oligoglycosides are known, and preferred, nonionic surfactants which correspond to formula $R—O—[G]_p$ in which R is an alkyl and/or alkenyl group containing 6 to 22 carbon atoms, G is a sugar unit containing 5 or 6 carbon atoms and p is a number of 1 to 10. They may be obtained by the relevant methods of preparative organic chemistry. The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides. The index p in general formula indicates the degree of oligomerization (DP), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization of less than 1.7 and, more particularly between 1.2 and 1.4 are preferred from the applicational point of view. The alkyl or alkenyl group R may be derived from primary alcohols containing 4 to 11 and preferably 8 to 10 carbon atoms.

Typical examples of cationic surfactants are quaternary ammonium compounds and quaternized fatty acid trialkanolamine esters. Typical examples of amphoteric or zwitterionic surfactants are alkyl betaines, alkyl amidobetaines, aminopropionates, aminoglycinates, imidazolinium betaines and sulfobetaines.

As the most preferred use of the monoesters of isosorbide according to the present invention is in dish detergents, such compositions containing the monoesters are also encompassed by the inventive teaching. The monoesters might be present in dish detergents in amounts from 0.5 to 45 wt. %, whereby a content of 1.0 to 15 wt. % is preferred. Dish detergents could be solid (in powder form, as granules, or as shaped bodies, like tablets), or liquid as well as form high viscous gels. The dish detergents contain typically a builder, nonionic surfactants, polymers, and other additives, like hydrotopes, preservatives, pH-regulators, perfume, soil-repellents, silver protection aids, corrosion inhibitors, bleaches, enzymes and the like.

Useful organic builders are, for example, the polycarboxylic acids usable in the form of their sodium salts, such as citric acid, adipic acid, succinic acid, glutaric acid, tartaric acid, sugar acids, aminocarboxylic acids, nitrilotriacetic acid (NTA), providing its use is not ecologically unsafe, and mixtures thereof. Preferred salts are the salts of the polycarboxylic acids, such as citric acid, adipic acid, succinic acid, glutaric acid, tartaric acid, sugar acids and mixtures thereof. The acids per se may also be used. Besides their building effect, the acids also typically have the property of an acidifying component and, hence, also serve to establish a relatively low and mild pH value in detergents or cleaners. Citric acid, succinic acid, glutaric acid, adipic acid, gluconic acid and mixtures thereof are particularly mentioned in this regard.

Suitable enzymes are, in particular, enzymes from the class of hydrolases, such as proteases, esterases, lipases or lipolytic enzymes, amylases, cellulases or other glycosyl hydrolases and mixtures thereof. All these hydrolases contribute to the removal of stains, such as protein-containing, fat-containing or starch-containing stains, and discoloration in the washing process.

Suitable soil repellents are polymers which preferably contain ethylene terephthalate and/or polyethylene glycol terephthalate groups, the molar ratio of ethylene terephthalate to polyethylene glycol terephthalate being in the range from 50:50 to 90:10. The molecular weight of the linking polyethylene glycol units is more particularly in the range from 750 to 5,000, i.e. the degree of ethoxylation of the polymers containing polyethylene glycol groups may be about 15 to 100. The polymers are distinguished by an average molecular weight of about 5,000 to 200,000 and may have a block structure, but preferably have a random structure. Preferred polymers are those with molar ethylene terephthalate: polyethylene glycol terephthalate ratios of about 65:35 to about 90:10 and preferably in the range from about 70:30 to 80:20. Other preferred polymers are those which contain linking polyethylene glycol units with a molecular weight of 750 to 5,000 and preferably in the range from 1,000 to about 3,000 and which have a molecular weight of the polymer of about 10,000 to about 50,000.

Among the compounds yielding $H_2O_2$ in water which serve as bleaching agents, sodium perborate tetrahydrate and sodium perborate monohydrate are particularly important. Other useful bleaching agents are, for example, sodium percarbonate, peroxypyrophosphates, citrate perhydrates and $H_2O_2$-yielding peracidic salts or peracids, such as perbenzoates, peroxophthalates, diperazelaic acid, phthaloiminoperacid or diperdodecanedioic acid. The content of peroxy bleaching agents in the compositions is preferably 5 to 35% by weight and more preferably up to 30% by weight, perborate monohydrate or percarbonate advantageously being used.

In addition, hydrotropes, for example ethanol, isopropyl alcohol or polyols, may be used to improve flow behavior. Suitable polyols preferably contain 2 to 15 carbon atoms and at least two hydroxyl groups. The polyols may contain other functional groups, more particularly amino groups, or may be modified with nitrogen.

Other suitable ingredients of the detergents are water-soluble inorganic salts, such as bicarbonates, carbonates, citrates, amorphous silicates, and normal waterglasses without prominent builder properties or mixtures thereof.

The monoesters will also be capable of thickening aqueous solutions, so that this particular use is also subject to the present invention. The monoesters show also a pearlizing effect comparable to standard pearlizing agents like ethylene glycol distearate (Cognis Cutina AGS), and so far this use is also an embodiment of this invention.

EXAMPLES

Preparation of the Isosorbide Esters 4 mol isosorbide (584.6 g), 0.8 g hexadecanol (205.1 g) and the catalyst Fascat 2001 (1.58 g) are introduced into a reactor and the mixture was heated to 220° C. Once the reaction is completed, the 2 phases in the reaction mixture are separated at 80° C. and the upper phase is washed 3 times with warm water, and dried in a vacuum to give a brownish solid at room temperature (21° C.).

Performance Tests of the Isosorbide Derivatives

Thickening Test:

12 wt % Plantapon® SF (100 g) and 1 wt % Isosorbide-monoester were introduced in a beaker and stirred in the water bath until the monoester was dissolved. The beaker was completed to 100 g with distilled water. The pH value is set to 5.8 through addition of citric acid. After all air bubbles are removed from the solution, and the solution is tempered at 21° C., the viscosity was measured using a viscosimeter 'Brookfield LVT'. For the shorter chains (C12, C14) the isosorbide monoester-surfactant mixes showed viscosities up to 6100 mPas.

Pearlizing Test:

1 wt % Isosorbide-monoester was incorporated in the following formulation and compared visually to the standard formulation containing the common pearlizing agent Cutina® AGS.

Pearlizing Formulation:

| Compound | Amount [wt %] |
|---|---|
| Sodium Laureth Sulfate | 32.0 |
| Coco-Glucoside | 3.0 |
| Cocamidopropyl Betaine | 3.5 |
| Dyestuff (1% in $H_2O$) | 0.1 |
| Preservative | 0.1 |
| NaCl | 2.5 |
| Water | 57.8 |
| Pearlizing Agent | 1.0 |

Rinse Performance Tests:

Four isosorbide esters were tested for their rinse performance in automatic dish detergents. In particular the following compounds have been tested: (I) Isosorbide mono C12-ester, (II) Isosorbide mono C14-ester, (III) Isosorbide mono C16-ester, (IV) Isosorbide mono C18-ester. As comparison (V) a hydroxy mixed ether compound has been used (those compounds are described in detail in EP 1897933 A1, paragraphs [0017]-[0019]). Furthermore, a C22 diester of isosorbide (VI) has also been tested for comparison purposes.

These compounds have been introduced into the following base formulation as surfactant for a granular automatic dish detergent:

| Compound | Amount [wt %] |
|---|---|
| Surfactant | 2.0 |
| Polycarboxylate | 1.0 |
| Sodium silicate | 7.0 |
| Sodium triphosphate | 52.0 |
| TAED | 2.5 |
| Sodium carbonate | 27.5 |
| Sodium_percarbonate | 8.0 |

Tests have been performed in a Miele automatic dishwasher, (water hardness 21° dH, 21 g used per run, 100 g test soil were used). Rinse performance was then evaluated visually.

In this process, dishes of glass, stainless steel, china and various plastics are washed in a domestic dishwasher under the conditions as set out above. The washed items are then evaluated for spotting and filming according to a standard scale, ranking from 1 (worse) to 10 (best) for spotting and 1 (worse) to 5 (best) for filming. The results are given in FIG. 1 for spotting properties accordingly.

It could be shown that the isosorbide monoesters show better rinse performance, compared with the standard, which is a sorbitan mono-stearat (SMS). The isosorbide monoesters with alky chains containing of 12 to 14 C-atoms show the best results. The long chain C22-diester (VI) shows results worse than the standard and worse than the compounds (I) and (II) respectively.

These results could be reproduced, whereby a commercial available multifunctional dish detergent has been tested with the isosorbide monoesters as surfactant (4 wt %, based on the detergent). Again, the isosorbide monoesters show similar performance when compared to a hydroxy alkyl ether surfactant. This test also shows that the isosorbide monoesters according to the invention could be incorporated without problems into standard multifunctional dish detergents.

The invention claimed is:

1. A method of preparing a household cleanser or detergent, the method comprising adding an isosorbide monoester, according to general formula (I)

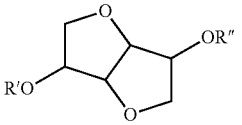

(I)

wherein R' or R" represent a hydrogen atom, or a group CO—R'", with the proviso that one group R' or R" is a hydrogen atom, and R'" represents a linear or branched, saturated or unsaturated alkyl- or alkenyl group with 6 to 22 C-atoms in a household cleanser or detergent.

2. The method of claim 1, wherein the compound according to formula (I) is selected such that, R'" represents a linear, saturated alkyl moiety with 8 to 22, C -atoms.

3. The method of claim 1, wherein the isosorbide monoester is present in an amount in the range of 0.1 to 25 wt %, based on the total weight of the cleanser or detergent.

4. The method of claim 1, wherein the household detergent is a dish washing detergent.

5. The method of claim 1, wherein the household cleanser or detergent further comprises a nonionic surfactant.

6. The method of claim 1, wherein the isosorbide monoester is free of sorbitan or sorbitan esters.

7. The method of claim 1, wherein the isosorbide monoester according to general formula (I) is used as a thickening agent in aqueous detergents or cleansers.

8. The method of claim 1, wherein the isosorbide monoester according to general formula (I) is used as a pearlizer in aqueous surfactant solutions.

9. The method of claim 2, wherein R'" represents a linear, saturated alkyl moiety with 12 to 20 C atoms.

10. The method of clam 9, wherein R'" represents a linear, saturated alkyl moiety with 14 to 18 C atoms.

11. The method of claim 3, wherein the isosorbide monoester is present in an amount of from 2 to 10 wt %, based on the total weight of the cleanser or detergent.

12. The method of claim 11, wherein the isosorbide monoester is present in an amount in the range of 4 to 6 wt %, based on the total weight of the cleanser or detergent.

13. The method of claim 4, wherein the household detergent is an automatic dish washing detergent.

* * * * *